United States Patent [19]

Milligan et al.

[11] 4,413,997

[45] Nov. 8, 1983

[54] DICARBAMOYLSULFONATE TANNING AGENT

[75] Inventors: Brian Milligan, North Balwyn, Australia; Peter R. Buechler, Wyncote; Stephen H. Feairheller, Wyndmoor, both of Pa.

[73] Assignee: The United States of America as represented by the Secretary of Agriculture, Washington, D.C.

[21] Appl. No.: 464,530

[22] Filed: Feb. 7, 1983

[51] Int. Cl.[3] ..... C14C 3/06; C14C 3/28; C14C 3/08

[52] U.S. Cl. ..... 8/94.21; 8/94.33

[58] Field of Search ..... 8/94.21, 94.33

[56] References Cited

U.S. PATENT DOCUMENTS 2,923,594 2/1960 Lieberman et al. ..... 8/94.33

OTHER PUBLICATIONS

Milligan et al., "The Use of Dicarbamoylsulfonates as Tanning Agents", J.A.L.C.A. 77, 70–83, 1982.

*Primary Examiner*—Maria Parrish Tungol
*Attorney, Agent, or Firm*—M. Howard Silverstein; William E. Scott; David G. McConnell

[57] ABSTRACT

A new tanning agent, isophorone dicarbamoylsulfonate, is provided for tanning cattle hides and sheepskins. A white leather which does not discolor with exposure to sunlight and which has good fill and tensile strength is produced. The tanning agent is also effective for retanning slack chrome-tanned and zirconium-tanned cattle hides and sheepskins.

11 Claims, No Drawings

DICARBAMOYLSULFONATE TANNING AGENT

BACKGROUND OF THE INVENTION

1. Field of The Invention

The invention relates to a method of tanning hides and skins and also to a method of retanning hides and skins. More specifically it relates to the use of a certain dicarbamoylsulfonate as a novel tanning and retanning agent for hides and skins.

2. Description of The Art

The bisulfilte adducts of tolylene diisocyanate, n-butyl-isocyanate and hexamethylene diisocyanate are known to be tanning agents for catgut, U.S. Pat. No. 2,923,594, but not for any type of hides and skins. The hexamethylene and tolylene adducts are also known to increase the viscosity of solutions of gelatin, U.S. Pat. No. 3,220,864. Dicarbamoylsulfonates made from tolylene diisocyanate and hexamethylene diisocyanate were tested as tanning agents but it was found that very few crosslinks were introduced, J. Soc. Leather Trades Chem. 49, 455, 1965.

SUMMARY OF THE INVENTION

An object of this invention is to provide a new method of tanning hides and skins.

Another object is to provide a novel tanning agent.

A further object is to provide a method of tanning which yields a white leather that does not discolor in sunlight.

A still further object is to provide a leather having good tensile strength, improved resistance to enzymic digestion, improved fill and increased shrinkage temperature.

Still another object is to provide a method of retanning chrome tanned hides.

A still further object is to provide a method of preparing tanned hides and skins in which the amount of chromium salts required is considerably less than that used to make a fully chrome-tanned leather.

Still another further object is to provide a method of greatly reducing the amount of chromium in tannery effluent wastes.

According to this invention the above objects are accomplished by a method in which hides and skins are tanned or in which slack-tanned hides and skins are retanned with an aqueous solution of isophorone dicarbamoylsulfonate.

DESCRIPTION OF THE INVENTION

Chromium salts are by far the most widely used tanning agents, although the resultant leather is often retanned with vegetable tannins or syntans. Recent environmental regulations, requiring the removal of all but traces of chromium from tannery wastes, and a predicted world-wide shortage of chromium in the future, have prompted this search for alternative tanning agents. One possibility is to develop tanning agents capable of replacing chromium entirely, while another is to find retanning agents which would lessen the amount of chrome required for tanning initially.

There are hundreds of bifunctional organic compounds capable of introducing covalent crosslinks into collagen, and therefore with the potential to serve as tanning agents. However, only two covalent crosslinking agents, formaldehyde and glutaraldehyde, have seen significant industrial use. The unique combination of properties that results from successful tannage obviously requires much more than the simple introduction of crosslinks. Probably the number, size, and location of the crosslinks, as well as any change in the electrostatic charge and hydrophilic/hydrophobic character of the collagen, all play a part in determining the properties of the resultant leather.

Diisocyanates have been used to tan leather by the introduction of covalent crosslinks. This tannage has been carried out both in anhydrous organic solutions and in aqueous emulsions. Disadvantages which have prevented commercial adoption include the toxicity of isocyanates, the use of organic solvent, or the loss of tanning agent by competitive hydrolysis during aqueous treatment.

The tanning agent of this invention is a dicarbamoylsulfonate. Dicarbamoylsulfonates are commonly referred to as bisulfite adducts of the corresponding diisocyanate. A method of forming carbamoylsulfonate ion by reaction of an isocyanate with bisulfite ion as in the following equation $$RN{=}C{=}O + HSO_3^- \longrightarrow RN{-}\overset{\overset{H}{\|}}{C}{-}\overset{\overset{O}{\|}}{}SO_3^-$$

has been described in Justus Liebigs Ann. Chem., 562, 205, 1948. If the bisulfite ion is accompanied by a highly solubilizing cation, for example, in the case of sodium bisulfite, a soluble carbamoylsulfonate salt is formed. The tanning agent of this invention as well as the carbamoylsulfonates prepared for comparative purposes are water soluble and reasonably resistant to neutral and acid solutions in contrast to the parent isocyanates. The specific dicarbamoylsulfonate with which this invention is concerned is that prepared from isophorone diisocyanate (IPDI); this dicarbamoylsulfonate or bisulfite adduct will be referred to as IPDI.BA.

The invention is exemplified as follows:

Pickled New Zealand sheepskins were degreased with kerosene, rinsed with 6 percent sodium chloride solution, and stored at 4° C. before use. Hereford cattle hides were unhaired, limed, split (to 9 oz.), delimed, bated and pickled, and stored in the pickle liquor (pH 2.2) before use. Hexamethylene diisocyanate and tolylene diisocyanate (a mixture containing 80 percent of the 2,4-isomer and 20 percent of the 2,6-isomer) were converted to their bisulfite adducts by the methods described in Aust. J. Chem. 25, 2583, 1972 and ibid 29, 2201, 1976. These compounds, hexamethylene diisocyanate bisulfite adduct (HMDI.BA) and tolylene diisocyanate bisulfite adduct (TDI.BA) were made for comparative purposes.

Isophorone diisocyanate was converted to its bisulfite adduct by stirring a solution of the diisocyanate (67 g) in dioxane (120 ml) with an aqueous solution (180 ml) of sodium metabisulfite (63 g) at 30° C. for 2 days. Addition of ethanol (3 l) to the resultant homogeneous solution precipitated the bisulfite adduct, which was collected, washed with ethanol, and dried in vacuo.

IPDI.BA, TDI.BA and HMDI.BA were obtained in yields of 88%, 87%, and 79%, respectively and were 86%, 88% and 95% pure, respectively.

Hide samples (usually 30 cm×30 cm) were treated at room temperature (about 20°–25° C.) in 1.8 liter jars tumbled at a rate of 40 r.p.m. Pickled hide was used directly for chrome tannage, but was adjusted to pH 4–5 before the organic tanning agents were applied. The amounts of materials used for treatment are expressed as percentages of the original pickled stock weight.

Chrome tannage The pickled stock was tumbled for 1 hr. with sodium chloride (4 percent), sodium formate (0.5 percent), and sufficient sulfuric acid in water (100 percent) to adjust the liquor to pH 1.8. A solution of Tanolin R (a sugar reduced basic chromium sulfate having a basicity of 34–37%) (8 percent) previously made up in boiling water (70 percent) and cooled was then added, and tumbling continued for 3–4 hr. Aliquots of an aqueous solution of sodium bicarbonate (0.5 percent) were next added at 30 min. intervals until the liquor reached and maintained pH 4.0.

Tannage with bisulfite adducts Pickled stock (adjusted to pH 4–5) or slack-tanned (incompletely or partially chrome-tanned) leather or zirconium tanned leather was tumbled for 30 min. with the appropriate bisulfite adduct (10–20 percent) in water (100 percent). For the purposes of this invention slack-tanned leather was produced by tanning with a solution containing an amount of chromium salts equivalent to between 30 and 60% of the amount required to fully chrome-tan the sheepskins and cattlehides. In the case of TDI.BA aliquots of an aqueous solution of sodium bicarbonate (0.5–1.0 percent) were then added at 15–20 min. intervals until pH 7.0 was reached (about 2 hr.), followed by aliquots of sodium carbonate solution (0.3–0.6 percent) until the liquor reached and maintained a pH of 8.0. Excessive foaming was inhibited by adding a foam suppressing agent. When using HMDI.BA or IPDI.BA, aliquots of sodium carbonate solution (0.5–1.0 percent) were added at 15–20 min. intervals throughout, until the liquor maintained a pH of 9.0±0.5. Treatment was continued until iodometric titration of a portion of the liquor showed that 90–95 percent of the bisulfite adduct had reacted. About 5 hr. was usually required for tannage. At this stage the leather was rinsed, adjusted to pH 4–5 by tumbling in dilute acetic acid, and rinsed again. Part of the sample was dried for analysis, and the remainder was fatliquored.

Fatliquoring, samming, and staking All leather samples were adjusted to pH 4–5, rinsed, drained, and then tumbled (initially at 40° C.) with Reilly-Whiteman, Inc. solvent fatliquor×76–31 (5 percent) in water (100–150 percent) for 1–2 hrs. (other suitable fatliquors may be used). They were then rinsed briefly, set out, and allowed to dry at room temperature. Water (35 percent) was added to the dry samples which were stored in plastic bags overnight and then staked by hand (sheepskin) or mechanically (cattle hide).

Shrinkage temperatures were measured with a Theis shrinkage meter using strips of wet leather taken prior to fatliquoring.

Enzymic digestibility was determined by the following procedure. Tanned sheepskin samples (prior to fatliquoring) and depickled sheepskin (as a control) were finely powdered in a Wiley mill (3 passes, #10 mesh). Weighed samples (ca. 25 mg) of known moisture content were shaken at 38° C. with:

(1) a 0.1 percent solution of trypsin in 0.1 M $NaHCO_3$,
(2) a 0.1 percent solution of pepsin in 0.2 M HCl, or
(3) a 0.1 percent solution of pronase in 0.05 percent borate buffer (pH 8.0).

Enzyme solutions were also incubated alone to permit correction of the results for autolysis. After incubation for 18 hrs. the samples were diluted with water (18.0 ml), filtered, and aliquots (0.2 or 0.4 ml) analysed for their peptide content with ninhydrin reagent. The resultant purple solutions were analysed with a Beckman DB spectrophotometer at 570 nm, and the enzymic digestibility of the various samples calculated as a percentage of that of depickled sheepskin.

Tensile strengths were determined with an Instron tensile tester (model TTB) according to ASTM-D-2209-64 on leather strips cut parallel to the backbone. The samples were conditioned at 22° C. and 51 percent relative humidity for 48 hr. before measurement.

Ball bursting strength was obtained according to ASTM D-2207-64 and grain crack data on a Satra Lastometer apparatus according to SLP-9 (IUP/9), Official Method of Analyses of International Society of Leather Trades Chemists-Physical Testing.

Torsional moduli were determined according to ASTM-D-2821-72, using a Williamson type semi-automatic wire stiffness tester (British Plastics 23,87, 1950).

Resistance to proteolytic enzymes is sometimes used to assess the effectiveness of a tanning agent, as it estimates leather's ability to withstand fungal and bacterial deterioration under damp or wet conditions. Tannages with the bisulfite adducts of the three diisocyanates confer excellent resistance to digestion by the enzymes, pronase, pepsin, and trypsin. These leather samples are considerably more resistant to proteolytic digestion than the conventionally chrome-tanned sample.

In addition to its resistance to proteolytic enzymes, leather produced by tanning sheepskin and cattle hide with isophorone dicarbamoylsulfonate is white and does not discolor when exposed to sunlight while that produced by tolylene dicarbamoylsulfonate is cream colored and discolors rapidly in sunlight. Leather produced by tanning sheepskin and cattle hide with hexamethylene dicarbamoylsulfonate was found to be an inferior and unsatisfactory product. For example, when equal amounts (20% of pickled sheepskin weight) of hexamethylene dicarbamoylsulfonate and isophorone dicarbamoylsulfonate were each employed as sole tanning agents for sheepskin, the hexamethylene dicarbamoylsulfonate product was found inferior to the isophorone dicarbamoylsulfonate product in shrinkage temperature, plumping activity and resistance to enzymic digestion as shown in the Table I.

Retannage of slack chrome-tanned sheepskin and cattle hide with IPDI.BA and TDI.BA improved the fullness, resilience, temper, flexibility, break, color, and enzyme resistance of the chrome-tanned leather. While the leather produced by retannage with TDI.BA was full and had good resilience, break, flexibility, and enzyme resistance, it was cream colored and discolored rapidly in sunlight. Leather produced by retannage with IPDI.BA was bluish-white, did not discolor in sunlight, and was a fuller leather with a higher tensile strength than that produced by retannage with TDI.BA. When zirconium tanned sheepskin or cattle hide was substituted for the chrome-tanned leather and retanned with IPDI.BA, pure white leathers without even the slight bluish cast and with good light stability were obtained.

Although HMDI.BA was apparently a good tanning agent for catgut, U.S. Pat. No. 2,923,594, it produced inferior leather when used to tan sheepskins and cattle hides. Unlike the equal reactivity of the reactive carbamoylsulfonate groups in the aliphatic dicarbamoylsulfonate, HMDI.BA, the reactive groups of IPDI.BA have unequal reactivity and we believe that superior leather is produced by IPDI.BA because one of the groups reacts with the collagen of the hide or skin while the other reactive group is free to react with more dicarbamoylsulfonate or polymerize and form optimum chain lengths for crosslinking.

TABLE I

| | Hexamethylene Dicarbamoylsulfonate Product | Isophorone Dicarbamoylsulfonate Product |
|---|---|---|
| Shrinkage Temperature | 69° C. | 72° C. |
| Thickness | 0.50 mm | 0.74 mm |
| Enzymic Digestibility* by | | |
| Pronase | 24 | 8 |
| Pepsin | 24 | 6 |
| Trypsin | 4 | 0 |

*As a percentage of the enzymic digestibility of depickled sheepskin.

We claim:

1. A method of making leather comprising treating cattle hides and sheepskins to the tanning action of an aqueous solution of isophorone dicarbamoylsulfonate.

2. A method of tanning cattle hides and sheepskins, comprising the step of (a) tumbling the hides and skins in an aqueous solution of isophorone dicarbamoylsulfonate;

(b) adjusting the pH of the mixture of step (a) to and maintaining it at pH 9.0±0.5 until 90% or more of the isophorone dicarbamoylsulfonate has reacted;

(c) removing the hides and skins from the solution of step (b) and rinsing them with water;

(d) tumbling the rinsed hides or skins in dilute organic acid to adjust the pH to 4.0–5.0;

(e) rinsing the tanned hides and skins from step (d) in water.

3. The method of claim 2 wherein the aqueous tanning solution contained from 10 to 20% of isophorone dicarbamoylsulfonate.

4. A method of retanning chrome-tanned cattle hides and sheepskins comprising treating the hides and skins with an aqueous solution of isophorone dicarbamoylsulfonate.

5. In a method of preparing tanned hides and skins, the improvement wherein the amount of chromium used is reduced to about from 30 to 60% of that required to fully chrome-tan said hides and skins, said improvement consisting of chrome-tanning the hides and skins with said reduced amount of chromium and retanning said chrome-tanned hides and skins by treating them with an aqueous solution of isophorone dicarbamoylsulfonate.

6. A method of reducing the amount of chromium in tannery wastes comprising (a) carrying out a first tanning of cattle hides and sheepskins in a tanning solution containing an amount of chromium salts equivalent to about from 30 to 60% of that required to fully chrome-tan said hides and skins; and (b) retanning said chrome-tanned hides and skins with an aqueous solution of isophorone dicarbamoylsulfonate.

7. A method of producing bluish-white leather comprising (a) tanning sheepskins and cattlehides with a tanning solution containing an amount of chromium salts equivalent to about from 30 to 60% of that required to fully chrome-tan said skins; and (b) retanning said chrome-tanned hides and skins with an aqueous solution of isophorone dicarbamoylsulfonate.

8. A method of producing light-stable white leathers by retanning zirconium-tanned hides and skins with an aqueous solution of isophorone dicarbamoylsulfonate.

9. Leather produced by subjecting cattle hides and sheepskins to the tanning action of an aqueous solution of isophorone dicarbamoylsulfonate.

10. Leather produced by retanning slack chrome-tanned cattle hides and skeepskins with an aqueous solution of isophorone dicarbamoylsulfonate, said hides and skins have been chrome-tanned with an amount of chromium salts equivalent to about from 30 to 60% of that required to fully chrome-tan the hides and skins.

11. White leather produced by retanning zirconium-tanned cattle hides and sheepskins with an aqueous solution of isophorone dicarbamoylsulfonate.

* * * * *